US005144718A

United States Patent [19]

Ozawa

[11] Patent Number: 5,144,718

[45] Date of Patent: Sep. 8, 1992

[54] DOOR PULL WITH MOUNTING FITTINGS

[75] Inventor: Akio Ozawa, Toyama, Japan

[73] Assignee: YKK Architectural Products Inc., Tokyo, Japan

[21] Appl. No.: 718,992

[22] Filed: Jun. 21, 1991

[30] Foreign Application Priority Data

Jun. 22, 1990 [JP] Japan ..... 2-65504

[51] Int. Cl.[5] ..... E05B 1/00

[52] U.S. Cl. ..... 16/111 R; 16/DIG. 5; 16/DIG. 41

[58] Field of Search ..... 16/111 R, 114 R, DIG. 5, 16/DIG. 33, DIG. 41; 74/543; 403/372, 365

[56] References Cited

U.S. PATENT DOCUMENTS

| | | | |
|---|---|---|---|
| 2,084,777 | 6/1937 | Poggensee | 403/365 |
| 2,731,662 | 1/1956 | Mills | 16/111 R |
| 2,870,493 | 1/1959 | Beyrle | 16/111 R |
| 2,886,354 | 5/1959 | Bjorklund | 403/372 |
| 2,931,078 | 4/1960 | Beyrle | 16/111 R |
| 2,961,694 | 11/1960 | May | 16/111 R |
| 3,017,657 | 1/1962 | Mills | 16/114 R |
| 3,827,183 | 8/1974 | Zimmerman et al. | 16/111 R |
| 3,990,185 | 11/1976 | Nagase | 16/111 R |
| 3,994,608 | 11/1976 | Swiderski et al. | 403/372 |
| 4,912,809 | 4/1990 | Scheuer | 16/114 R |

*Primary Examiner*—Lowell A. Larson
*Assistant Examiner*—Michael J. McKeon
*Attorney, Agent, or Firm*—Hill, Van Santen, Steadman & Simpson

[57] ABSTRACT

A door pull comprises a pull member and a pair of fittings coupled with opposite ends of the pull member. The door pull is attached to a door by these fittings.

2 Claims, 4 Drawing Sheets

DOOR PULL WITH MOUNTING FITTINGS

BACKGROUND OF THE INVENTION

1. Field of the Invention

This invention relates to a door pull for opening and closing a door.

2. Description of the Related Art

There is currently known a door pull which comprises a long hollow pull member and a pair of fittings attached to opposite ends of the pull member and which is adapted to be mounted on a door by connecting these fittings with machine screws.

However such a door pull is not only difficult to couple the fittings to the opposite ends of the pull member but also becomes shaky when the machine screws are loosened, thereby making a user feel uncomfortable.

SUMMARY OF THE INVENTION

It is therefore an object of this invention to provide a door pull which can solve inconveniences experienced with conventional door pulls.

According to a first aspect of this invention, there is provided a door pull to be attached to a door by using stiles, comprising: a hollow long pull member; a first fitting to be coupled to one end of the hollow long pull member; a second fitting to be coupled to the other end of the hollow long pull member; and elastic tubular spacers. The pull member coupled to the first and second fittings via the spacers is mounted on the door very strongly and steadily.

According to a second aspect of this invention, there is provided a door pull to be attached to door by using stiles, comprising: a hollow long pull member; a first fitting to be coupled to one end of the hollow long pull member, the first fitting including a fitting body, a projection extending therefrom and a first contact side to come into contact with the door; and a second fitting to be coupled to the other end of said hollow long pull member, the second fitting including a fitting body, a projection and a second contact side to come into contact with the door.

With this arrangement, the distance between the first contact side of the first fitting and a lower side of the pull member is shorter than the distance between the second contact side of the second fitting and the lower side of the pull member so that the door pull is elastically deformed so as to have the first and second contact sides of the first and second fittings contacted with the stiles of the door.

The above and other advantages, features and additional objects of this invention will be manifest to those versed in the art upon making reference to the following detailed description and the accompanying drawings in which a preferred embodiment incorporating the principles of this invention is shown by way of an illustrative example.

DETAILED DESCRIPTION

Figure 2:
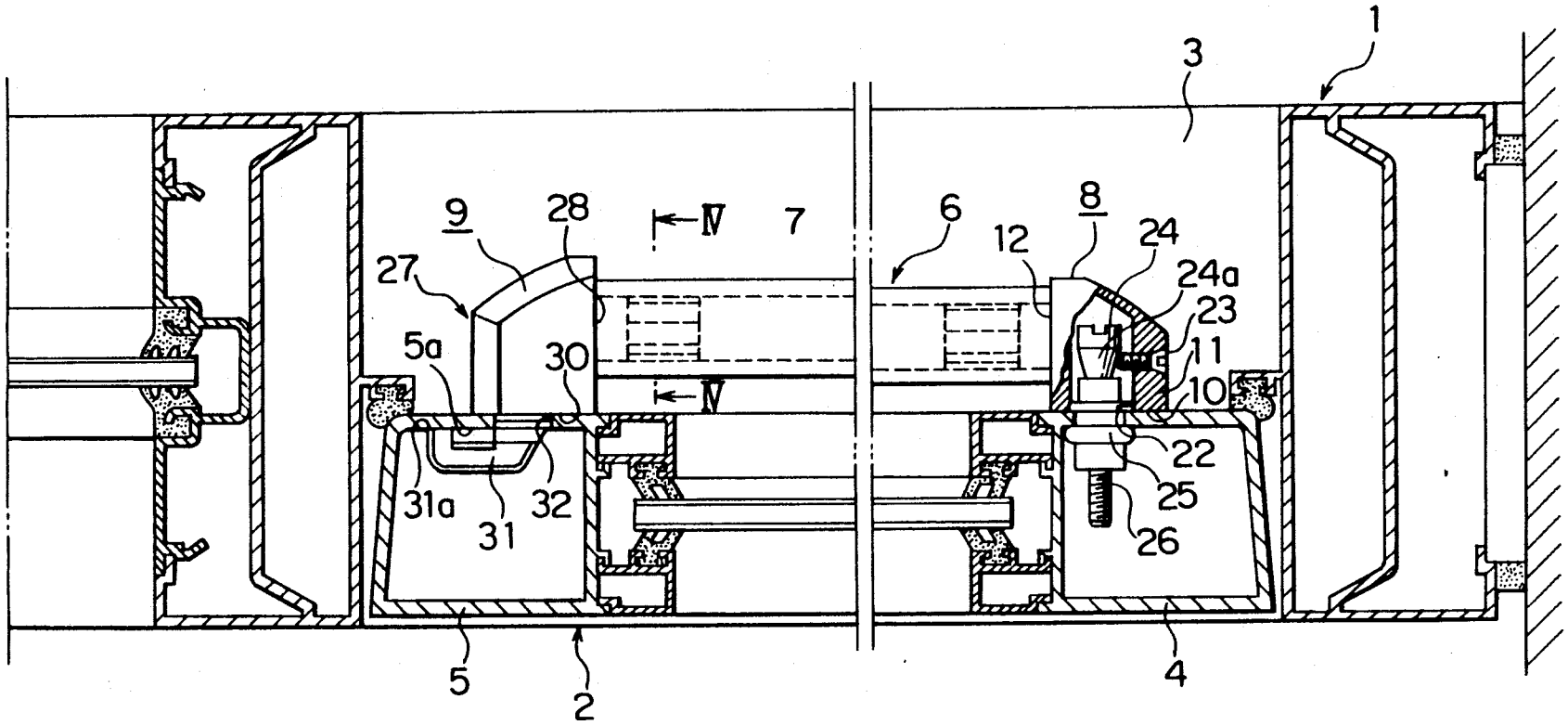
FIG. 2 is a cross-sectional view of fittings for mounting the door pull on a door.
Figure 4:
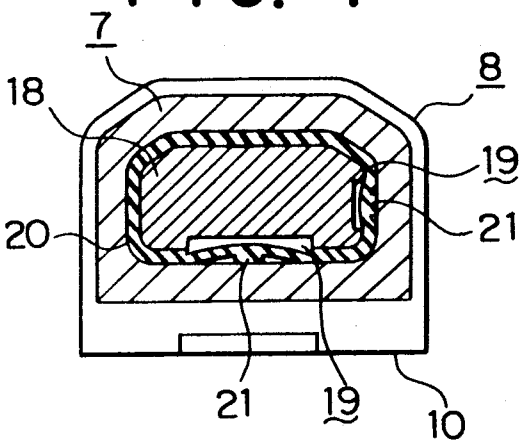
FIG. 4 is a cross-sectional view taken along the line IV—IV of FIG. 2.

As shown in FIG. 2, a door 2 is installed in a door frame 1 so as to be openable and closable. Upper and lower portions 3 of the door frame 1 are connected to a first stile 4 of the door 2 by non-illustrated hinges. A door pull 6 is mounted on the door 2 between the first and second stiles 4, 5. The door pull 6 comprises a long hollow pull member 7 and a pair of fittings 8, 9 to be coupled with opposite ends of the pull member 7. The pull member 7 is connected to the first and second stiles 4, 5 via the fittings 8, 9, respectively. The fittings 8, 9 will hereinafter be called "the first fitting 8" and "the second fitting 9", respectively.

Figure 1:
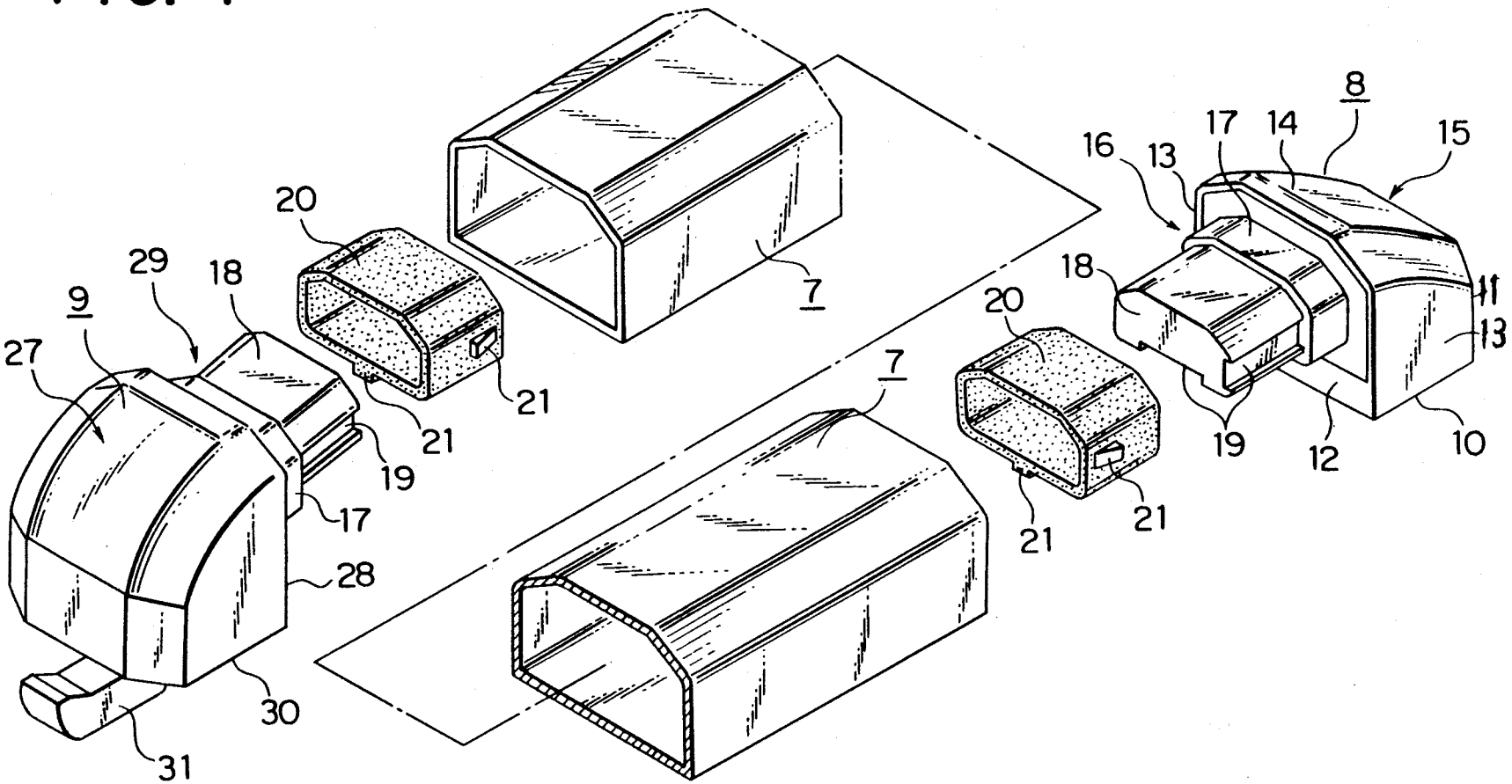
FIG. 1 is an exploded perspective view of a door pull according to one embodiment of this invention.
Figure 3:
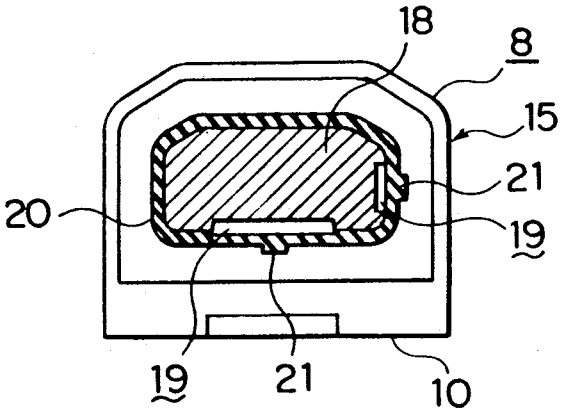
FIG. 3 is a cross-sectional view showing a spacer attached to one of the fittings.
Figure 5:
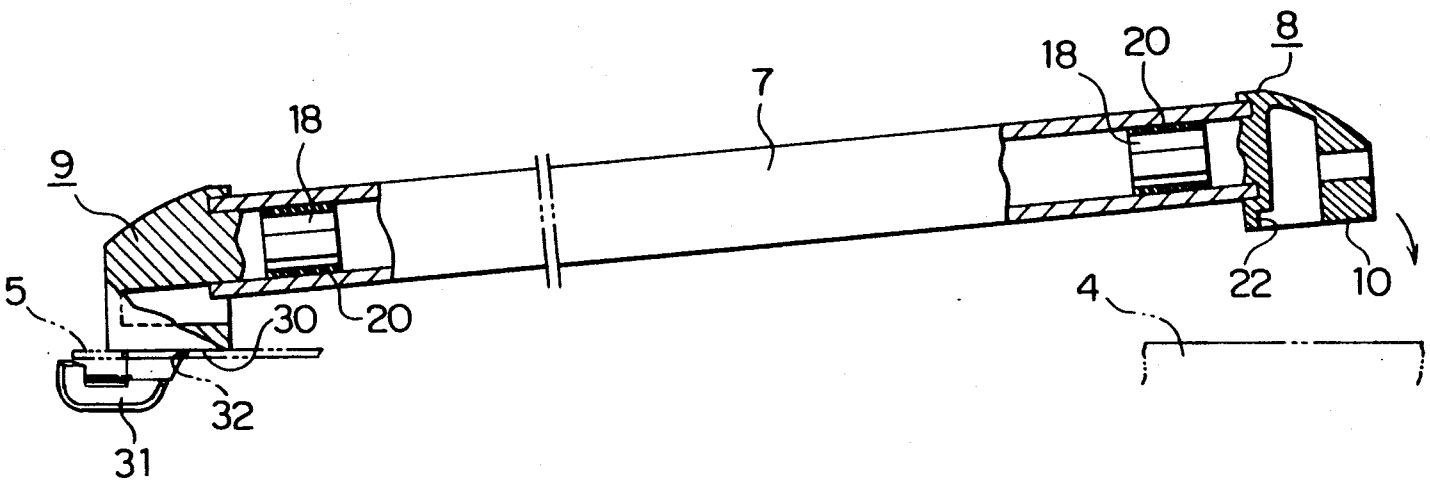
FIG. 5 shows the posture of the door pull before having been mounted on the door.

As shown in FIG. 1, the first fitting 8 includes a hollow block 15 and a projection 16 extending from the hollow block 15 integrally therewith. The hollow block 15 has sides 10, 11, 12 and 13. The projection 16 has a base 17 and an end 18 which is slightly thinner than the base 17. The end 18 of the projection 16 has grooves 19 on its outer surface. An elastic tubular spacer 20 of synthetic resin, for example, is attached to and around the end 18, as shown in FIG. 3. The spacer 20 is substantially identical in shape with the pull member 7, having wedges 21. When it is received between the pull member 7 and the end 18 of the projection 16, the spacer 20 is partially deformed inwardly by the wedges 21. Specifically, the spacer 20 is pushed into the grooves 19 of the end 18 by its own wedges 21 so that the pull member 7 is coupled with the first fitting 8 very firmly.

The side 10 of the hollow block 15 is to be in contact with the door and has a through hole 22, as shown in FIG. 2. The side 10 of the hollow block 15 is hereinafter called "the contact side 10". A machine screw 23 extends into the hollow block 15 through the side 11 of the hollow block 15. A screw bolt 24 fixed on the first stile 4 projects into the hollow block 15 via the through hole 22. The machine screw 23 is in press contact with a tapered portion 24*a* of the screw bolt 24, so that the contact side 10 of the hollow block 15 of the first fitting 8 is pressed toward the surface of the first stile 4.

The screw bolt 24 is attached to the first stile 4, and a threaded portion 26 of the bolt 24 threadedly received in a nut 25 of the first stile 4.

As shown in FIG. 1, the second fitting 9 includes a solid block 27 and a projection 29 extending from a side 28 of the solid block 27. The solid block 27 has a hook 31 extending integrally from a contact side 30 thereof. The contact side 30 is to be in contact with the door. The side 28 and the contact side 30 of the solid block 27 are at a right angle to each other. The projection 29 is parallel to the contact side 30, but slightly slanting upwardly.

The projection 29 has a base 17 and an end 18 which are similar to those of the projection 16 of the first fitting 8 described above. The end 18 of the projection 29 is fitted in the pull member 7 via another spacer 20. The hook 31 is inserted in an opening 32 of the second stile 5 so as to contact an end 31*a* of the hook 31 with an inner surface 5*a* of the second stile 5.

The door pull 6 is to be assembled and mounted on the door as described below.

The opposite ends of the door pull member 7 are coupled with the first and second fittings 8, 9 via the spacers 20. The hook 31 of the second fitting 9 is inserted through the opening 32 of the second stile 5, being turned so as to connect the second fitting 9 to the second stile 5.

Under this condition, the door pull 6 is not parallel to the surface of the door 2. Specifically, the distance between the lower surface of the pull member 7 and the contact side 10 of the first fitting 8 is shorter than the distance between the lower surface of the pull member 7 and the contact side 30 of the second fitting 9.

Then the first fitting 8 is pressed toward the first stile 4 so that the screw bolt 24 extends into the hollow block 15 of the first fitting 8. Thereafter, the machine screw 23 is tightened toward the tapered portion 24*a* of the bolt 24, thereby fastening the first fitting 8 to the first stile 4.

The pull member 7 is coupled firmly and strongly with the fittings by the resiliency of the components described above. Thus the coupled portions have been assembled very stably so that the door pull 6 can function reliably.

As shown in FIG. 2, the clearance between the pull member 7 and the second stile is wide enough to assure that a user can grip the door pull easily and reliably.

Figure 6:
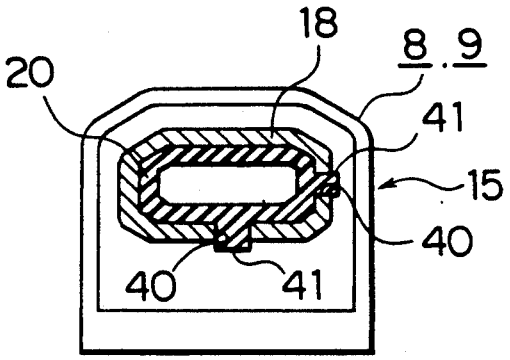
FIG. 6 is a cross-sectional view showing a modified spacer attached to the fitting.
Figure 7:
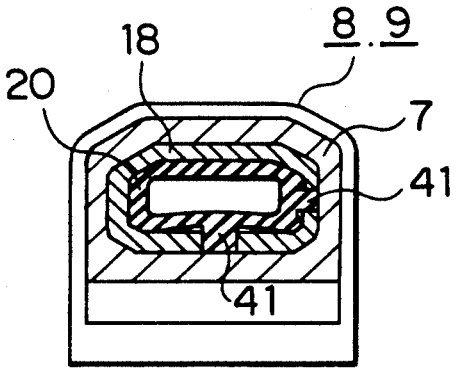
FIG. 7 is a cross-sectional view showing the pull member receiving the fitting and the spacer.

FIGS. 6 and 7 show a modified coupling between the pull member and the first or second fitting 8, 9. In this example, the end 18 of the projection 16 of the fitting 8, 9 is hollow and has grooves 40. The spacer 20 has juts 41 on its outer surface, and is fitted into the hollow end 18. When the end 18 of the projection 16 is received in the pull member 7, the juts 41 are pressed against the inner circumferential surface of the pull member 7 so that the spacer 20 is elastically deformed, thereby causing the end 18 to come in firm contact with the inner surface of the pull member 7. Therefore, the pull member 7 is coupled with the fittings 8, 9 very strongly and stably.

In the foregoing embodiment, the distance between the lower part of the pull member 7 and the contact side 10 of the first fitting 8 is shorter than the distance between the lower part of the pull member 7 and contact side 30 of the second fitting 9. Otherwise, these distances may be equal to each other so that the pull member is in parallel to the surface of the door. In addition, the outer circumferential shape of the projections 16, 29 may be substantially complement with the inner circumferential shape of the pull member 7, and the spacers may be dispensed with.

According to this invention, the spacers are attached to and around the projections of the fittings. When the opposite ends of the pull member are coupled with the fittings, the spacers will be elastically deformed between the door pull member and the projections so that both the pull member and the fittings can be assembled very easily, firmly and reliably. The assembled door pull is to be then attached to the door and can function reliably and stably.

What is claimed:

1. A door pull adapted to be attached to a door by using stiles, comprising:

(a) a long hollow pull member;

(b) a first fitting adapted to be coupled with one end of said pull member and adapted to be attached to the door by a stile, said first fitting including a fitting body and a projection extending therefrom;

(c) a second fitting adapted to be coupled with the other end of said hollow long pull member and adapted to be attached to the door by another stile, said second fitting including a fitting body and a projection extending therefrom; and (d) elastic tubular spacers including wedges and adapted to be fitted around said projections, said spacers are elastically deformed by said wedges between said pull member and said first and second fitting when each end of said pull member is coupled with said first and second fitting to hold each said spacer thereon.

2. A door pull adapted to be attached to a door by using stiles, comprising:

(a) a long hollow pull member;

(b) a first fitting adapted to be coupled with one end of said pull member and adapted to be attached to the door by a first stile, said first fitting including a fitting body, a projection extending therefrom, and a first contact side adapted to come into contact with the door, said projection including a base having a shape substantially the same as an inner circumferential surface of said pull member, and an end having an outer circumferential surface that is substantially smaller than said shape of said base;

(c) a second fitting adapted to be coupled with the other end of said pull member and adapted to be attached to the door by a second stile, said second fitting including a fitting body, a projection extending therefrom, and a second contact side to come in contact with the door, said projection including a base having a shape substantially the same as an inner circumferential surface of said pull member, and an end having an outer circumferential surface that is substantially smaller than said base, said second fitting further including a hook provided integrally on said second contact side thereof, said hook being adapted to fit into an opening in said second stile; and (d) elastic tubular spacers including wedges and adapted to be fitted around said projections, said spacers being elastically deformed by said wedges when said wedges are compressed between said pull member and said first and second fitting, when each end of said pull member is coupled with said first and second fitting to hold each said spacer thereon, each of said spacers being coupled to and around respective ends of said pull member, with both said spacer and said base being coupled within said pull member;

whereby said door pull is adapted to be installed on the door by inserting said hook on said second fitting into said opening of said second stile, pressing said first fitting toward said first stile until said first contact side abuts said first stile, and securing said first fitting to said first stile.

* * * * *